US011170957B2

(12) United States Patent
Kitagawa et al.

(10) Patent No.: US 11,170,957 B2
(45) Date of Patent: Nov. 9, 2021

(54) SEAL STRUCTURE OF ELECTRONIC DEVICE, ELECTRONIC DEVICE PROVIDED WITH SEAL STRUCTURE, AND MANUFACTURING METHOD OF ELECTRONIC DEVICE

(71) Applicant: Omron Corporation, Kyoto (JP)

(72) Inventors: Tatsuro Kitagawa, Koshi (JP); Norio Fukui, Yamaga (JP); Ryoichi Kido, Kumamoto (JP); Naoki Kawaguchi, Yame (JP)

(73) Assignee: Omron Corporation, Kyoto (JP)

( * ) Notice: Subject to any disclaimer, the term of this patent is extended or adjusted under 35 U.S.C. 154(b) by 203 days.

(21) Appl. No.: 16/471,641

(22) PCT Filed: Dec. 13, 2017

(86) PCT No.: PCT/JP2017/044715

§ 371 (c)(1),
(2) Date: Jun. 20, 2019

(87) PCT Pub. No.: WO2018/159065

PCT Pub. Date: Sep. 7, 2018

(65) Prior Publication Data

US 2020/0126744 A1 Apr. 23, 2020

(30) Foreign Application Priority Data

Feb. 28, 2017 (JP) ..... JP2017-037544

(51) Int. Cl.
*H01H 13/04* (2006.01)
*H01H 50/02* (2006.01)
*H01H 49/00* (2006.01)

(52) U.S. Cl.
CPC ..... *H01H 50/023* (2013.01); *H01H 49/00* (2013.01)

(58) Field of Classification Search
CPC ..... H01H 50/023; H01H 49/00; H01H 50/642
(Continued)

(56) References Cited

U.S. PATENT DOCUMENTS 4,761,627 A * 8/1988 Bell ..... H01H 50/26 335/128
5,270,674 A * 12/1993 Nakanishi ..... H01H 50/026 335/78

(Continued)

FOREIGN PATENT DOCUMENTS

CN 1499557 A 5/2004
CN 106030749 A 10/2016

(Continued)

OTHER PUBLICATIONS

International Search Report issued in Application No. PCT/JP2017/044715, dated Feb. 20, 2018 (2 pages).

(Continued)

*Primary Examiner* — Shawki S Ismail
*Assistant Examiner* — Lisa N Homza
(74) *Attorney, Agent, or Firm* — Osha Bergman Watanabe & Burton LLP

(57) ABSTRACT

A seal structure of an electronic device is provided with: a housing in which a base and a case are sealed by a sealant and a closed space enclosed by the base and the case is provided; and at least one of terminals having a body and a leg. The base includes a terminal groove that accommodates the body, a through hole that accommodates the leg, and a placement area forming part that forms a placement area for the sealant together with the body, the leg, the terminal groove, and the through hole, the placement area extending from the outside of the housing toward the closed space through an interval between the through hole and the leg and an interval between the terminal groove and the body.

7 Claims, 6 Drawing Sheets

(58) Field of Classification Search
USPC ..... 335/202
See application file for complete search history.

(56) References Cited

U.S. PATENT DOCUMENTS 5,289,144 A * 2/1994 Liao ..... H01H 50/041 335/78
5,757,255 A * 5/1998 Noda ..... H01H 50/642 335/78
6,211,761 B1 * 4/2001 Yoshino ..... H01H 50/023 335/282
6,903,639 B2 * 6/2005 Sanada ..... H01H 50/023 335/129
7,782,162 B2 * 8/2010 Nishida ..... H01H 50/56 335/201
8,558,647 B2 * 10/2013 Shinkai ..... H01H 50/023 335/78
8,922,307 B2 * 12/2014 Fujimoto ..... H01H 50/24 335/78
2004/0113729 A1 * 6/2004 Sanada ..... H01H 50/642 335/129
2004/0119566 A1 * 6/2004 Sanada ..... H01H 50/56 335/128
2017/0076893 A1 3/2017 Tsutsui et al.

FOREIGN PATENT DOCUMENTS

JP S63-6647 U 1/1988
JP H02-143751 U 12/1990
JP H04-40444 U 4/1992
JP H08-7735 A 1/1996
JP 2012-43642 A 3/2012

OTHER PUBLICATIONS

Written Opinion issued in International Application No. PCT/JP2017/044715, dated Feb. 20, 2018 (8 pages).
International Preliminary Report on Patentability issued in Application No. PCT/JP2017/044715, dated Mar. 4, 2019 (6 pages).
Office Action issued in corresponding Chinese Application No. 201780076522.1 dated May 27, 2020 (12 pages).

* cited by examiner

SEAL STRUCTURE OF ELECTRONIC DEVICE, ELECTRONIC DEVICE PROVIDED WITH SEAL STRUCTURE, AND MANUFACTURING METHOD OF ELECTRONIC DEVICE

TECHNICAL FIELD

The present disclosure relates to a seal structure of an electronic device, an electronic device provided with the seal structure, and a method for manufacturing the electronic device.

BACKGROUND ART

Patent Document 1 discloses an electromagnetic relay provided with: a housing formed of a plate-like base and a case in a box shape covering one surface of the base in the plate-thickness direction; and a terminal fixed to the base. The electromagnetic relay has a seal structure in which a joint portion between the base and the case is sealed by a sealant, and the seal structure ensures the airtightness inside the housing.

PRIOR ART DOCUMENT

Patent Document

Patent Document 1: Japanese Unexamined Patent Publication No. 2012-043642

SUMMARY OF THE INVENTION

Problems to be Solved by the Invention

In the electromagnetic relay, a terminal is made up of a body extending in the thickness direction of the base and fixed to the base, and a leg extending from the body to the outside of the housing through the base in the thickness direction of the base. For this reason, at the time of filling the joint portion between the base and the case with a sealant, the sealant may flow into the inside of the housing through an interval between the base and the terminal due to the capillary phenomenon or the like.

However, in the seal structure of the electromagnetic relay, it is difficult to restrict the range of the sealant flowing into the inside of the housing, so that the sealant disposed inside the housing tends to vary, and the reliability of the electromagnetic relay may decrease.

Therefore, an object of the present disclosure is to provide a seal structure capable of ensuring the reliability of the electronic device, an electronic device provided with the seal structure, and a method for manufacturing the electronic device.

Means for Solving the Problem

A seal structure of one aspect of the present disclosure is a seal structure of an electronic device, provided with: a housing that includes a base having a connection end face and a case in a box shape covering one end opening surface in a direction intersecting with the connection end face of the base, the housing having on an inside a closed space enclosed by the base and the case, with a sealant sealing the base and the case; and at least one of terminals that includes a body extending in the direction intersecting with the connection end face of the base and disposed in the closed space, the body being fixed to the base, and a leg extending from the body to an outside of the housing through the base in the direction intersecting with the connection end face of the base. The base includes a terminal groove opened to the closed space and configured to accommodate the body, a through hole extending from the terminal groove in the direction intersecting with the connection end face of the base and configured to accommodate a part of the leg, and a placement area forming part configured to form a placement area for the sealant together with the body and the leg of the terminal and the terminal groove and the through hole of the base, the placement area extending from the outside of the housing toward the closed space through an interval between the through hole and the leg and an interval between the terminal groove and the body.

An electronic device of one aspect of the present disclosure is provided with the seal structure of the aspect.

A manufacturing method of one aspect of the present disclosure is a method for manufacturing an electronic device provided with a housing that includes a base having a connection end face and a case in a box shape covering one end opening surface in a direction intersecting with the connection end face of the base, the housing having on an inside a closed space enclosed by the base and the case, with a sealant sealing a joint portion between the base and the case, the electronic device being provided with at least one of terminals having a body disposed in the closed space and fixed to the base along the direction intersecting with the connection end face of the base, and a leg extending from the body to an outside of the housing through the base in the direction intersecting with the connection end face of the base. The base includes a terminal groove opened to the closed space and configured to accommodate the body, a through hole extending from the terminal groove in the direction intersecting with the connection end face of the base and configured to accommodate a part of the leg, and a sealant restriction part provided in an inflow path extending from the outside of the housing toward the closed space through an interval between the through hole and the leg and an interval between the terminal groove and the body, and after attachment of the case from the one end opening surface side of the base assembled with a fixed-contact-side terminal, a movable-contact-side terminal, an electromagnet, and a movable part, the electronic device is fixed in a state where the sealant flows from the connection end face side of the base toward the closed space, to fill a joint portion between the base and the case with the sealant, and the sealant restriction part restricts an inflow range of the sealant passing through the inflow path.

Effect of the Invention

According to the seal structure of the aspect, the placement area for the sealant extending from the outside of the housing toward the closed space through the interval between the terminal and the base is formed of the terminal, the base, and the placement area forming part. That is, the placement area forming part positions the sealant inside the housing. It is thereby possible to lessen the variation in the sealant disposed inside the housing and improve the reliability of the electronic device.

According to the electronic device of the aspect, with the seal structure of the aspect, it is possible to lessen the variation in the sealant disposed inside the housing and obtain a highly reliable electronic device.

According to the manufacturing method of the aspect, the range of the sealant flowing into the inside of the housing is restricted by the sealant restriction part provided in an inflow path extending from the outside of the housing toward the closed space through the interval between the through hole and the leg and the interval between the terminal groove and the body. Hence it is possible to lessen the variation in the range of the sealant flowing into the inside of the housing and manufacture a highly reliable electronic device.

MODE FOR CARRYING OUT THE INVENTION

Hereinafter, one aspect of the present disclosure will be described with reference to the accompanying drawings. In the following description, terms indicating specific directions or positions (e.g., terms including "upper", "lower", "right", and "left") are used as necessary. However, these terms are used to facilitate the understanding of the disclosure with reference to the drawings, and the meanings of the terms do not limit the technical scope of the present disclosure. The following description is merely exemplary in nature and not intended to limit the present disclosure, its application, or its usage. Further, the drawings are schematic, and ratios of dimensions or the like do not necessarily agree with actual ones.

First Embodiment

Figure 1:
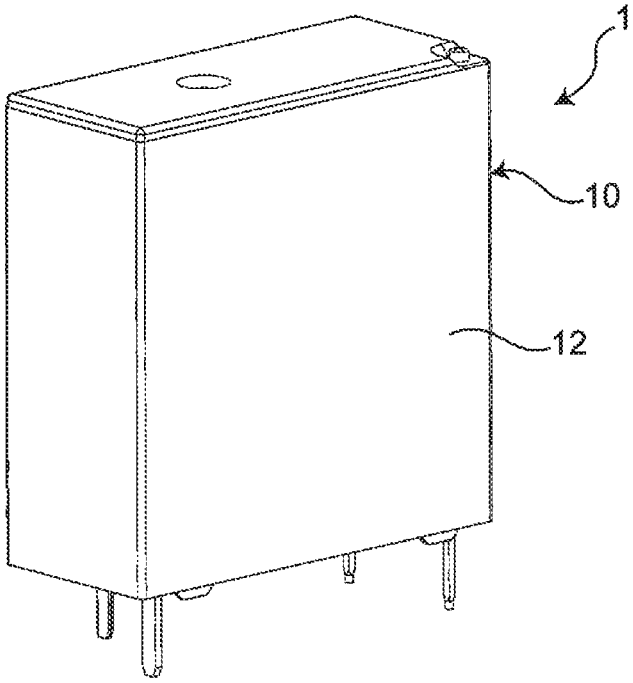
FIG. 1 is a perspective view of an electromagnetic relay according to a first embodiment of the present disclosure.
Figure 2:
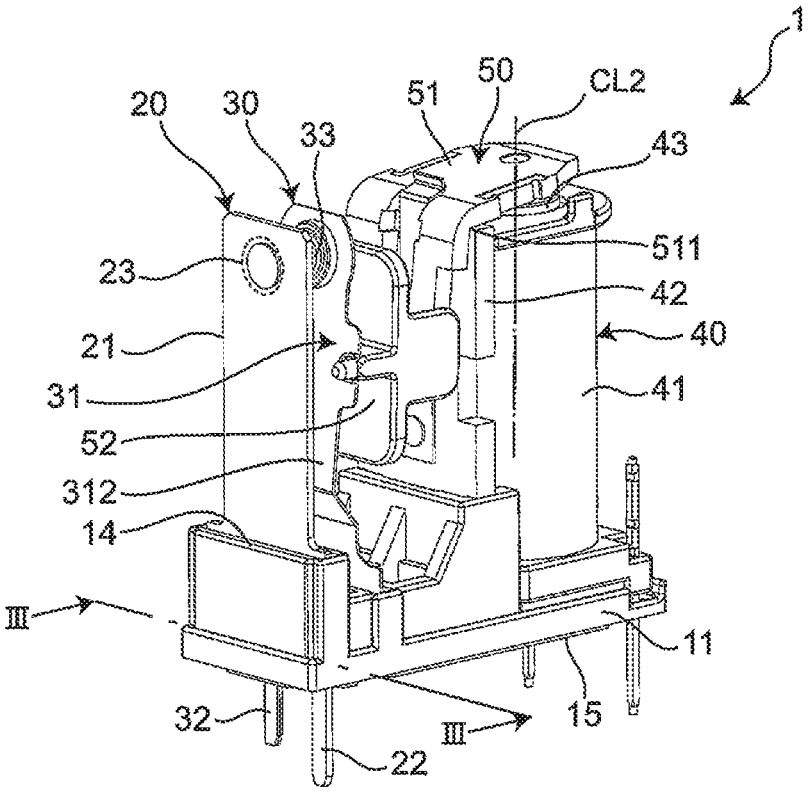
FIG. 2 is a perspective view of the electromagnetic relay of FIG. 1, from which a case and a sealant have been removed.

As illustrated in FIGS. 1 and 2, an electromagnetic relay 1 of an example of an electronic device of a first embodiment is provided with: an insulating housing 10 that includes a substantially rectangular base 11 having a connection end face (i.e., a bottom surface) 15 connected to a substrate or the like, and a hollow box-like case 12 covering one end opening surface (i.e., an top surface) 14 in a direction intersecting with the connection end face 15 of the base 11 (i.e., the vertical direction in FIGS. 1 and 2); and a fixed-contact-side terminal 20 having a substantially rectangular plate shape and fixed to the base 11.

Further, a movable-contact-side terminal 30 having a substantially rectangular plate shape is fixed to the base 11 so as to be elastically deformable. The top surface of the base 11 is provided with an electromagnet 40 and a movable part 50 connected to the movable-contact-side terminal 30 and the electromagnet 40. Note that the fixed-contact-side terminal 20 and the movable-contact-side terminal 30 are each an example of a terminal. That is, the electromagnetic relay 1 of the first embodiment is provided with two terminals.

Figure 3:
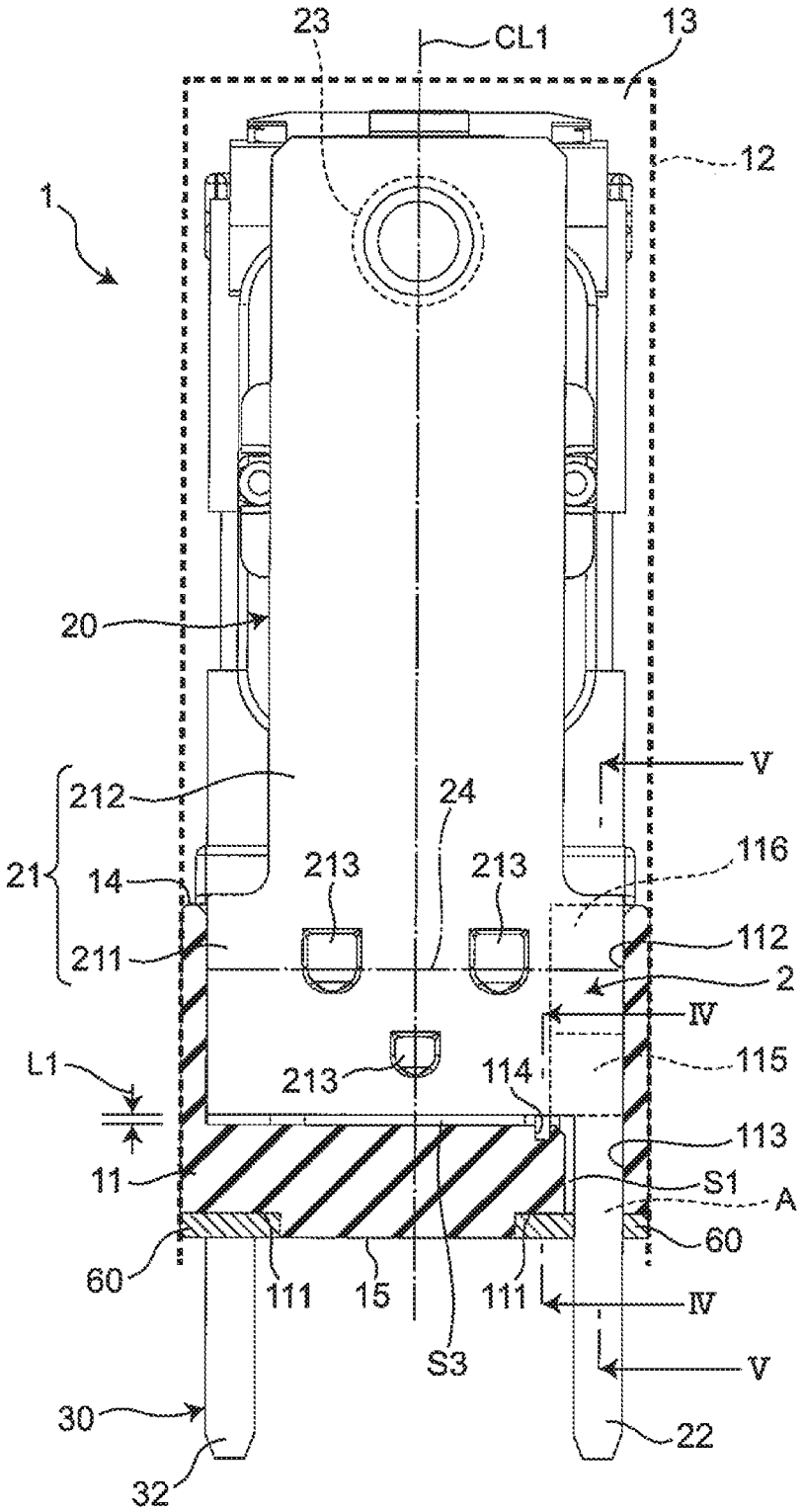
FIG. 3 is a sectional view taken along a line III-Ill of FIG. 2.

As illustrated in FIG. 3, a closed space 13 enclosed by the base 11 and the case 12 is provided inside the housing 10. Further, a seal groove part 111 provided along the outer peripheral edge is provided on the connection end face 15 of the base 11. A sealant 60 is provided in the seal groove part 111. That is, the base 11 and the case 12 of the housing 10 are sealed by the sealant 60.

As illustrated in FIG. 3, the base 11 is opened in the closed space 13 and includes two terminal grooves 112 (only one is illustrated in FIG. 3) extending in the lateral direction of the base 11 (i.e., the horizontal directions in FIG. 3) and a through hole 113 extends from each of the terminal grooves 112 in the direction intersecting with the connection end face 15 of the base 11 (i.e., the thickness direction). The two terminal grooves 112 are arranged in parallel at one end in the longitudinal direction of the base 11 at a predetermined interval. Further, each through hole 113 is arranged to open at the bottom surface of the seal groove part 111.

In the respective terminal grooves 112, a body 21 of the fixed-contact-side terminal 20 described later and a body 31 of the movable-contact-side terminal 30 described later are accommodated. In the respective through holes 113, a part of a leg 22 of the terminal 20 described later and a part of a leg 32 of the movable-contact-side terminal 30 described later are accommodated.

As illustrated in FIG. 2, the fixed-contact-side terminal 20 includes the body 21 extending in the thickness direction of the base 11 and disposed in the closed space 13 and fixed to the base 11, and includes the leg 22 extending from the body 21 to the outside of the housing 10 through the base 11 in the thickness direction of the base 11.

As illustrated in FIG. 3, the body 21 includes a base part 211 accommodated in the terminal groove 112 of the base 11, and a contact placement part 212 extending from the base part 211 in the thickness direction of the base 11.

The base part 211 is provided with three press-fit projections 213 which project in the thickness direction from one plate surface. Two of the three press-fit projections 213 are provided on the top-surface side of the base 11 and one is provided on the bottom-surface side of the base 11. The two press-fit projections 213 on the top-surface side of the base 11 are arranged symmetrically with respect to a center line CL1 extending in the longitudinal direction of the body 21, and one press-fit projection 213 on the bottom-surface side of the base 11 is arranged on the center line CL1.

Further, the base part 211 is provided with a spring fulcrum 24 disposed on a straight line connected the lower ends of the two press-fit projections 213 on the top-surface side of the base 11. That is, the body 21 of the fixed-contact-side terminal 20 has the spring fulcrum 24 extending in a direction parallel to the plate surface of the body 21 and orthogonal to the thickness direction of the base 11 and located in the terminal groove 112. The spring fulcrum 24 serves as a fulcrum of deformation when the fixed-contact-side terminal 20 is elastically deformed in the thickness direction.

The contact placement part 212 has a width (i.e., a length in the lateral direction of the body 21) smaller than that of the base part 211, and has a fixed contact 23 fixed to the longitudinal end remote from the base part 211.

The leg 22 is disposed at one end in the width direction (i.e., the horizontal direction in FIG. 3) of the base part 211 of the body 21. That is, the leg 22 is located at one end in the lateral direction of the base 11 (i.e., the right end in FIG. 3).

As illustrated in FIG. 2, the movable-contact-side terminal 30 includes the body 31 extending in the thickness direction of the base 11 and disposed in the closed space 13 and fixed to the base 11 so as to be elastically deformable, and includes the leg 32 extending from the body 31 to the outside of the housing 10 through the base 11 in the thickness direction of the base 11. The leg 32 of the movable-contact-side terminal 30 is disposed so as not to overlap with the leg 22 of the fixed-contact-side terminal 20 as viewed from the longitudinal direction of the base 11, and located at the other end in the lateral direction of the base 11 (i.e., the left end in FIG. 3).

The body 31 is configured in the same manner as the body 21 of the fixed-contact-side terminal. That is, the body 31 is made up of a base part (not illustrated) accommodated in the terminal groove 112 of the base 11, and a contact placement part 312 extending from the base part in the thickness direction of the base 11. The base part has three press-fit projections (not illustrated). In addition, the contact placement part 312 has a movable contact 33 fixed to a longitudinal end remote from the base. The movable contact 33 is disposed so as to be able to contact or separate from the fixed contact 23 by elastic deformation of the movable-contact-side terminal 30.

As illustrated in FIG. 2, the electromagnet 40 is disposed at the other end in the longitudinal direction of the top surface of the base 11. The electromagnet 40 has a coil part 41 having a coil wound about a winding axis CL2 extending in the thickness direction of the base 11, and a yoke 42 extending from the base 11 along the outer periphery of the coil part 41. A through hole (not illustrated) penetrating in the thickness direction of the base 11 is provided inside the coil part 41, and a long rod-like iron core (not illustrated) is disposed in the through hole. The longitudinal end of the iron core which is closer to the base 11 is connected to the yoke 42. In addition, a magnetic pole 43 exposed from the top surface of the coil part 41 is provided at the longitudinal end of the iron core which is farther from the base 11.

The movable part 50 is configured of an L-like plate-like movable iron piece 51 and a movable member 52 connected to the movable iron piece 51 and the contact arrangement portion 312 of the body 31 of the movable-contact-side terminal 30. The movable iron piece 51 has a corner 511 located at the upper end of the yoke 42 and is disposed so as to be pivotable about the corner 511.

In a natural state where no external force is applied, as illustrated in FIG. 2, the movable iron piece 51 moves the movable-contact-side terminal 30 toward the electromagnet 40 side in the longitudinal direction of the base 11 via a movable member 52, to separate the movable contact 33 from the fixed contact 23.

When a current is supplied to the electromagnet 40, the upper end of the movable iron piece 51 is attracted to the magnetic pole 43 of the iron core, and the movable iron piece 51 moves the movable-contact-side terminal 30 toward the fixed-contact-side terminal 20 via the movable member 52. This brings the movable contact 33 into contact with the fixed contact 23. Further, when the supply of the current to the electromagnet 40 is stopped while the movable contact 33 is in contact with the fixed contact 23, the attraction force having attracted the upper end of the movable iron piece 51 disappears, and the movable iron piece 51 moves the movable-contact-side terminal 30 to the electromagnet 40 side in the longitudinal direction of the base 11 via the movable member 52 to separate the movable contact 33 from the fixed contact 23.

Next, with reference to FIGS. 3 to 5, the seal structure of the electromagnetic relay 1 will be described in more detail.

The seal structure of the electromagnetic relay 1 is realized by the base 11 described below. Note that the fixed-contact-side terminal 20 and the movable-contact-side terminal 30 are accommodated in the terminal groove 112 and the through hole 113 having the same configuration. Therefore, here, the terminal groove 112 and the through hole 113 which accommodate the fixed-contact-side terminal 20 will be described.

As illustrated in FIG. 3, the terminal groove 112 has a length substantially the same as the width of the base part 211 of the fixed-contact-side terminal 20. The terminal groove 112 has such a depth (i.e., the length of the terminal groove 112 in the thickness direction of the base 11) that a shortest distance L1 between its bottom and the lower end face of the base part 211 of the fixed-contact-side terminal 20 is larger than zero and smaller than 0.2 mm.

As illustrated in FIG. 3, a recess 114 is provided at the bottom of the terminal groove 112 and in the vicinity of the through hole 113. The recess 114 is connected to a first portion 115 to be described later, and as illustrated in FIG. 4, the recess 114 is configured so that a shortest distance L2 from the bottom of the recess 114 to the fixed-contact-side terminal 20 is 0.2 mm or more.

In addition, as illustrated in FIG. 3, the terminal groove 112 has the first portion 115 disposed at an upper portion of the through hole 113 and connected to the through hole 113 and a second portion 116 disposed at an upper portion of the first portion 115 and connected to the first portion 115 and the closed space 13.

Figure 5:
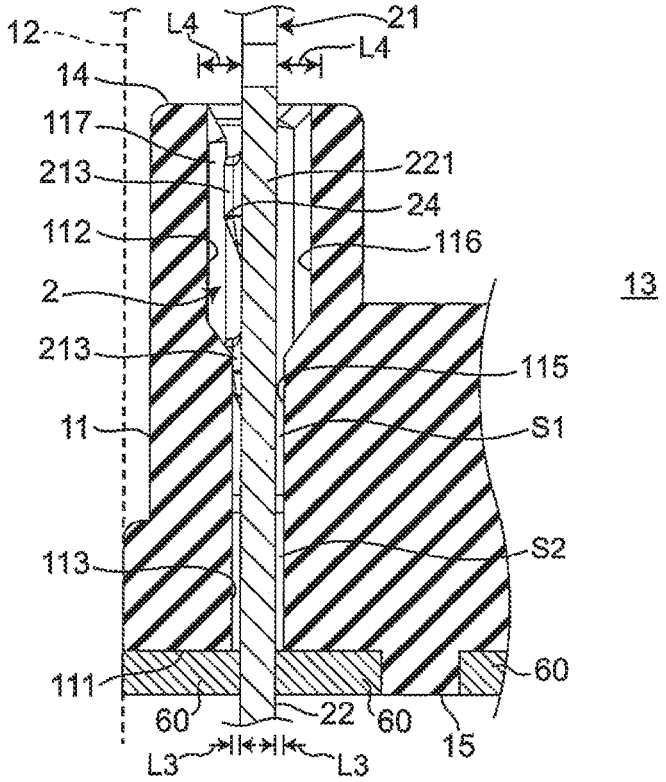
FIG. 5 is a sectional view taken along a line V-V of FIG. 3.

As illustrated in FIG. 5, the first portion 115 has the same dimension in the thickness direction of the fixed-contact-side terminal 20 (i.e., the horizontal direction in FIG. 5) as the through hole 113. Further, the second portion 116 in FIG. 2 has a dimension in the thickness direction of the fixed-contact-side terminal 20 larger than that of the first portion 115. Specifically, the first portion 115 is configured so that a shortest distance L3 between the first portion 115 and the base part 211 of the fixed-contact-side terminal 20 is larger than zero and smaller than 0.2 mm. The second portion 116 is configured so that a shortest distance L4 between the second portion 116 and the base part 211 of the fixed-contact-side terminal 20 is 0.2 mm or more. Note that the lower end of the second portion 116 is located closer to the connection end face (i.e., the bottom surface) 15 of the base 11 than the spring fulcrum 24 as illustrated in FIG. 3.

That is, the electromagnetic relay 1 has a gap S1 between the leg 22 of the fixed-contact-side terminal 20 and the through hole 113 of the base 11, and a gap S2 between the base part 211 of the fixed-contact-side terminal 20 and the first portion 115 of the base 11. The dimension of each of the gap S1 and the gap S2 is the distance L3. Further, the electromagnetic relay 1 has a gap S3 between the lower end face of the fixed-contact-side terminal 20 and the bottom of the terminal groove 112. The dimension of the gap S3 is the distance L1.

Figure 4:
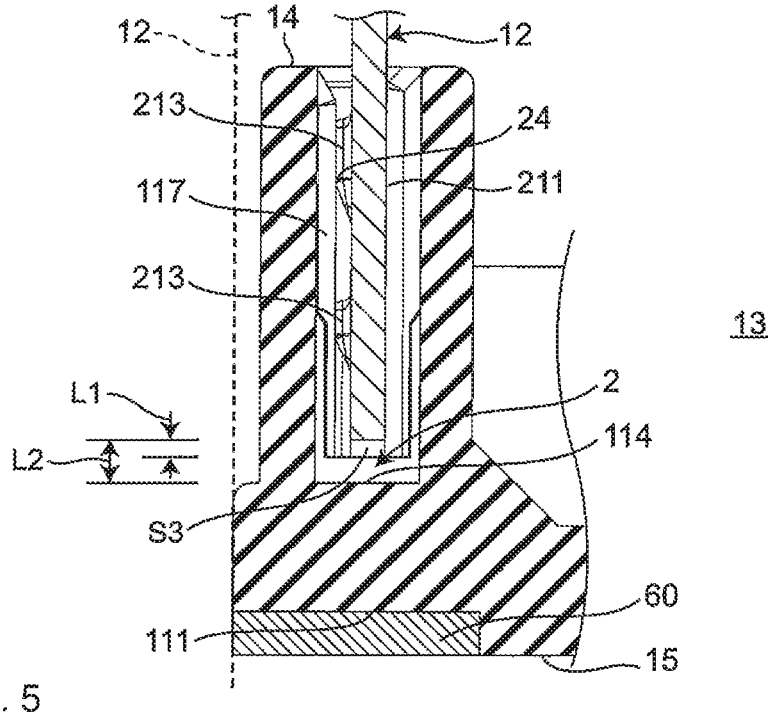
FIG. 4 is a sectional view taken along a line IV-IV of FIG. 3.

In addition, as illustrated in FIGS. 4 and 5, the inner surface of the terminal groove 112 is provided with a wall 117 in contact with the press-fit projection 213 of the accommodated fixed-contact-side terminal 20.

Subsequently, a method for manufacturing the electromagnetic relay 1 will be described.

First, the case 12 is attached from the top surface of the base 11 on which the fixed-contact-side terminal 20, the movable-contact-side terminal 30, the electromagnet 40, and the movable part 50 are assembled.

Then, the base 11 is fixed with its bottom surface turned upward, and the seal groove part 111 is filled with the sealant 60.

Generally, when the size of an inflow path A (illustrated in FIG. 3) through which the sealant 60 constituting the placement area for the sealant 60 flows, that is, the distance between the fixed-contact-side terminal 20 (or the movable-contact-side terminal 30) and the terminal groove 112 of the base 11 is larger than zero and smaller than 0.2 mm, the capillary phenomenon occurs. When the size of the inflow path A becomes 0.2 mm or more, the capillary phenomenon hardly occurs and the flow of the sealant 60 into the road A is stopped or reduced.

Since the shortest distance L3 between the leg 22 of the fixed-contact-side terminal 20 and the through hole 113 of the base 11 (and the shortest distance L3 between the leg 32 of the movable-contact-side terminal 30 and the through hole 113 of the base 11) is larger than zero and smaller than 0.2 mm, when the seal groove part 111 is filled with the sealant 60, the filled sealant 60 flows into the inside of the housing 10 through the gap S1 due to the capillary phenomenon.

In the electromagnetic relay 1, the terminal groove 112 has the recess 114 disposed at the bottom of the terminal groove 112 and the second portion 116 disposed between the first portion 115 and the closed space 13. The recess 114 is configured so that the shortest distance L2 from the bottom of the recess 114 to the fixed-contact-side terminal 20 is 0.2 mm or more, and the shortest distance L2 from the bottom of the recess 114 to the movable-contact-side terminal 30 is 0.2 mm or more. The second portion 116 is configured so that the shortest distance L4 to the base part 211 of the fixed-contact-side terminal 20 is 0.2 mm or more, and the shortest distance L4 to the base of the movable-contact-side terminal 30 is 0.2 mm or more. For this reason, the sealant 60 having flowed into the gap S1 between the leg 22 of the fixed-contact-side terminal 20 and the through hole 113 of the base 11 due to the capillary phenomenon is restricted in the range of the flow into the gap S2 between the base part 211 of the fixed-contact-side terminal 20 and the first portion 115 of the base 11 by the recess 114 and the second portion 116. The sealant 60 having flowed into the inside of the housing 10 is thus positioned. Similarly, the sealant 60 having flowed into the gap S1 between the leg 32 of the movable-contact-side terminal 30 and the through hole 113 of the base 11 is restricted in the range of the flow into the gap S2 between the base part of the movable-contact-side terminal 30 and the first portion 115 of the base 11 by the recess 114 and the second portion 116. The sealant 60 having flowed into the inside of the housing 10 is thus positioned. It is thereby possible to lessen the variation in the range of the sealant flowing into the inside of the housing, that is, the variation in the sealant 60 disposed inside the housing 10, and to manufacture the highly reliable electromagnetic relay 1.

Finally, the sealant 60 filled in the seal groove part 111 is cured to complete the manufacturing of the electromagnetic relay 1.

As described above, in the seal structure of the electromagnetic relay 1 according to the first embodiment, the recess 114 and the second portion 116 constitute the placement area forming part (i.e., the sealant restriction part) 2, and the placement area for the sealant 60, extending from the outside of the housing 10 toward the closed space 13 through an interval between the fixed-contact-side terminal 20 and the base 11, is formed of the fixed-contact-side terminal 20, the base 11, and the placement area forming part 2. Further, the placement area for the sealant 60, extending from the outside of the housing 10 toward the closed space 13 through an interval between the movable-contact-side terminal 30 and the base 11 is formed of the movable-contact-side terminal 30, the base 11, and the placement area forming part 2. That is, the placement area forming part 2 positions the sealant 60 inside the housing 10. It is thereby possible to lessen the variation in the sealant 60 disposed inside the housing 10, that is, the variation in the range in which the fixed-contact-side terminal 20 and the movable-contact-side terminal 30 are fixed to the terminal groove 112 of the base 11 by the sealant 60, and to improve the reliability of the electromagnetic relay 1.

Therefore, with the above seal structure, it is possible to lessen the variation in the sealant 60 disposed inside the housing 10 and obtain the highly reliable electromagnetic relay 1.

Note that the placement area forming part (i.e., the sealant restriction part) 2 is not limited to the recess 114 and the second portion 116 and may only restrict the range of the sealant 60 flowing into the inside of the housing 10 due to the capillary phenomenon when the electromagnetic relay 1 is manufactured. For example, when the shortest distance between the lower end face of the fixed-contact-side terminal 20 and the bottom of terminal groove 112 is 0.2 mm or more (similarly, when the shortest distance between the lower end face of the movable-contact-side terminal 30 and the bottom of terminal groove 112 is 0.2 mm or more), only the second portion 116 may be included in the placement area forming part (i.e., the sealant restriction part) 2, and the recess 114 can be omitted. That is, by providing the recess 114, the gap between the bottom surface of the fixed-contact-side terminal 20 and the bottom portion of the terminal groove 112 can be made larger than zero and smaller than 0.2 mm, so that it is possible to reduce the size of the electromagnetic relay 1 while improving the reliability of the electromagnetic relay 1.

When the shortest distance between the recess 114 and the fixed-contact-side terminal 20 is 0.2 mm or more (similarly, when the shortest distance between the recess 114 and the movable-contact-side terminal 30 is 0.2 mm or more), the recess 114 can be formed in a freely selected shape. For example, the recess 114 may be a V-groove or a cylindrical groove. Note that the recess 114 can be disposed at a freely selected position on the bottom of the terminal groove 112 so long as the sealant 60 having flowed inward through the gap S1 can reach the recess 114. That is, the vicinity of the through hole 113 refers to a range reachable by the sealant 60 having flowed inward through the gap S1.

Further, the lower end of the second portion 116 constituting the placement area forming part (i.e., the sealant restriction part) 2 is disposed closer to the base 11 than the spring fulcrum 24 in the thickness direction of the base 11. Hence the spring fulcrum 24 is not fixed to the base 11 by the sealant 60, so that it is possible to reduce the fluctuation of the spring characteristics of the fixed-contact-side terminal 20 and the movable-contact-side terminal 30 caused by the sealant 60.

Even when the lower end of the second portion is disposed farther from the base 11 than the spring fulcrum 24, it is possible to position the sealant 60 inside the housing 10 and lessen the variation in the sealant 60 disposed inside the housing 10.

Further, the dimensions of the gaps S1 to S3 may be the same or may fluctuate in the range of zero or more and less than 0.2 mm. That is, the leg 22 of the fixed-contact-side terminal 20 and the through hole 113 of the base 11, the base part 211 of the fixed-contact-side terminal 20 and the first portion 115 of the base 11, and the lower end face of the fixed-contact-side terminal 20 and the bottom of the terminal groove 112 may be partially in contact with each other. Similarly, the leg 32 of the movable-contact-side terminal 30 and the through hole 113 of the base 11, the base part of the movable-contact-side terminal 30 and the first portion 115 of the base 11, and the lower end face of the movable-contact-side terminal 30 and the bottom of the terminal groove 112 may be partially in contact with each other.

The fixed-contact-side terminal 20 and the movable-contact-side terminal 30 are not limited to the plate shape. The fixed-contact-side terminal 20 and the movable-contact-side terminal 30 can each be set to have a freely selected shape so long as including the body fixed to the base and the leg extending from the body to the outside of the housing through the base in the thickness direction.

The seal structure of the present disclosure is not limited to the electromagnetic relay 1 including the fixed-contact-side terminal 20 and the movable-contact-side terminal 30, and any electronic device can be applied so long as including at least one terminal.

Second Embodiment

Figure 6:
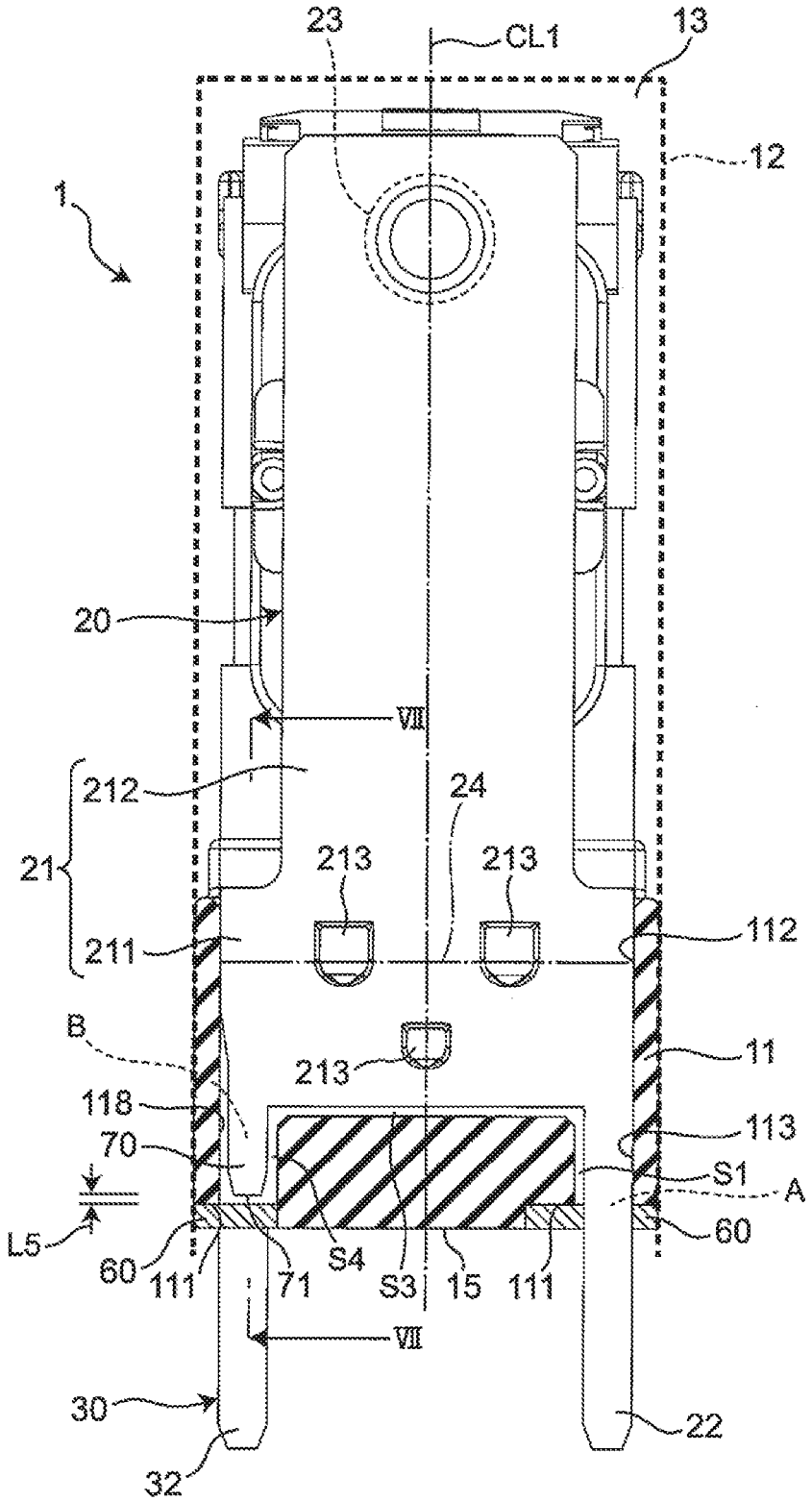
FIG. 6 is a sectional view of an electromagnetic relay according to a second embodiment of the present disclosure, taken along the line III-Ill in FIG. 2.
Figure 7:
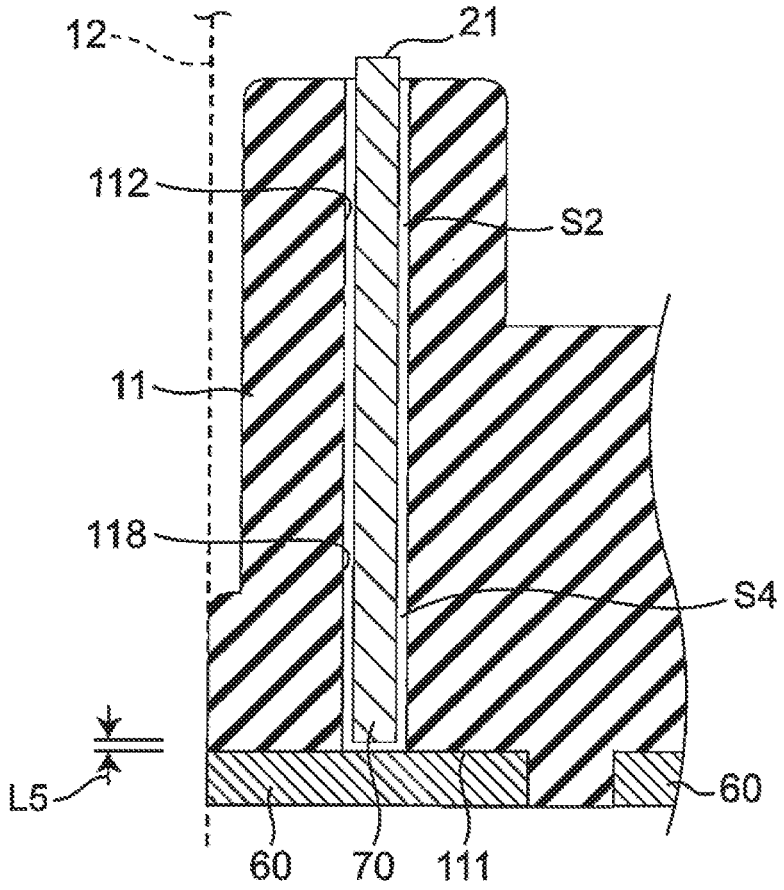
FIG. 7 is a sectional view taken along a line VII-VII of FIG. 6.

As illustrated in FIGS. 6 and 7, an electromagnetic relay 1 according to a second embodiment of the present disclosure is different from the first embodiment in that the fixed-contact-side terminal 20 and the movable-contact-side terminal 30 each include a sealant placement part 70 (FIGS. 6 and 7 illustrate only the sealant placement part 70 of the fixed-contact-side terminal 20) and that the sealant restriction part made up of the recess 114 and the second portion 116 is not provided in the base 11.

In the second embodiment, the same reference numerals are assigned to the same portions as those in the first embodiment, the description thereof will be omitted, and points different from the first embodiment will be described.

The seal structure of the electromagnetic relay 1 according to the second embodiment is realized by the fixed-contact-side terminal 20, the movable-contact-side terminal 30, and the base 11 which will be described below.

In the electromagnetic relay 1 of the second embodiment, the fixed-contact-side terminal 20 and the movable-contact-side terminal 30 respectively include legs 22, 32 provided at one ends in the width directions of bodies 21, 31 (i.e., the horizontal direction in FIG. 6), and the sealant placement parts 70 disposed at the other ends in the width directions of the bodies 21, 31 in parallel with the legs 22, 32. That is, the fixed-contact-side terminal 20 and the movable-contact-side terminal 30 respectively include the legs 22, 32 and the sealant placement parts 70 which are disposed symmetrically with respect to a center line CL1 extending in the longitudinal directions of the bodies 21, 31.

As in the first embodiment, the fixed-contact-side terminal 20 and the movable-contact-side terminal 30 are accommodated in a terminal groove 112 and through holes 113, 118 having the same configuration. Therefore, here, the terminal groove 112 and the through holes 113, 118 which accommodate the fixed-contact-side terminal 20 will be described.

As illustrated in FIGS. 6 and 7, the terminal groove 112 of the base 11 is provided with the through hole 118 (hereinafter, referred to as a second through hole) disposed in parallel with the through hole 113 (hereinafter, referred to as a first through hole). The first through holes 113 and the second through holes 118 are disposed at both ends in the longitudinal direction of the terminal groove 112 (i.e., the horizontal direction in FIG. 6). The leg 22 is accommodated in the first through hole 113, and the sealant placement part 70 is accommodated in the second through hole 118.

The sealant placement part 70 has a plate shape and is accommodated in the second through hole 118 in the terminal groove 112 of the base 11. The sealant placement part 70 is smaller in length from a base part 211 of the body 21 in the thickness direction of the base 11 (i.e., the vertical direction in FIG. 6) than the leg 22 and is configured so as not to project from the connection end face 15 of the base 11.

Specifically, a tip end face 71 of the sealant placement part 70 which is farther from the base part 211 of the body 21 in the thickness direction of the base 11 is disposed closer to the closed space 13 than the bottom surface of the base 11. A shortest distance L5 between the tip end face 71 of the sealant placement part 70 and a bottom surface 15 of the base 11 is larger than zero and smaller than 0.2 mm.

In addition, a gap S4 is provided between the sealant placement part 70 and the second through hole 118. The gap S4 has a dimension larger than zero and smaller than 0.2 mm. That is, the shortest distance between the sealant placement part 70 and the second through hole 118 is larger than zero and smaller than 0.2 mm.

Further, the sealant placement part 70 has a dimension in the width direction (i.e., the horizontal direction in FIG. 6) that is twice or more the dimension in the thickness direction (i.e., the horizontal direction in FIG. 7).

As described above, the seal structure of the electromagnetic relay 1 according to the second embodiment is formed with: a first placement area for the sealant 60 extending from the outside of the housing 10 toward the closed space 13 through an interval between the base 11 and the legs 22, 32 of the fixed-contact-side terminal 20 and the movable-contact-side terminal 30; and a second placement area for the sealant 60 extending from the outside of the housing 10 toward the closed space 13 through an interval between the base 11 and the sealant placement parts 70 of the fixed-contact-side terminal 20 and the movable-contact-side terminal 30. Therefore, for example, the first inflow path A constituting the first placement area for the sealant 60 and a second inflow path B constituting the second placement area for the sealant 60 are provided symmetrically with respect to the center line in the width directions of the bodies 21, 31 of the fixed-contact-side terminal 20 and the movable-contact-side terminal 30 (i.e., the legs 22, 32 and the sealant placement parts 70 are disposed on the bodies 21, 31 so that the first placement area is located on one side of the center line CL1 in the width directions of the bodies 21, 31 of the respective terminals 20, 30 and that the second placement area is located on the other side of the center line CL1 in the width directions of the bodies 21, 31 of the respective terminals 20, 30), whereby the sealant 60 disposed inside the housing 10 can be controlled. It is thereby possible to lessen the variation in the sealant 60 disposed inside the housing 10 and improve the reliability of the electromagnetic relay 1.

Further, the fixed-contact-side terminal 20 and the movable-contact-side terminal 30 include the legs 22, 32 and the sealant placement parts 70 disposed in parallel to the legs 22, 32. Hence it is possible to enhance the resistance of the fixed-contact-side terminal 20 and the movable-contact-side terminal 30 to twisting in the parallel direction of the legs 22, 32 and the sealant placement parts 70.

The tip end face 71 of the sealant placement part 70 is disposed closer to the closed space 13 than the bottom surface 15 of the base 11. This facilitates the inflow of the sealant 60 via the second placement area due to the capillary phenomenon, thus it is possible to more reliably lessen the variation in the sealant 60 disposed inside the housing 10.

The distance L5 between the tip end face 71 of the sealant placement part 70 and the bottom surface 15 of the base 11 is larger than zero and smaller than 0.2 mm. This facilitates the inflow of the sealant 60 via the second placement area due to the capillary phenomenon, thus it is possible to more reliably lessen the variation in the sealant 60 disposed inside the housing 10.

Further, in the directions in which the legs 22, 32 and the sealant placement parts 70 intersect with the connection end face 15 of the base 11 (i.e., the thickness direction), the legs 22, 32 and the sealant placement part 70 are respectively disposed at both ends of the bodies 21, 31 in the width directions orthogonal to the plate thickness directions of the plate-like bodies 21, 31. Hence it is possible to more reliably lessen the variation in the sealant 60 disposed inside the housing 10.

The dimension in the width direction of the sealant placement part 70 is twice or more the dimension in the thickness direction of the sealant placement part 70. This can further enhance the resistance of the fixed-contact-side terminal 20 and the movable-contact-side terminal 30 to torsion.

Note that the sealant placement part 70 may only be disposed in parallel to the respective legs 22, 32 of the fixed-contact-side terminal 20 and the movable-contact-side terminal 30. The sealant placement part 70 is not limited to the case of being disposed symmetrically with respect to the center line CL1 extending in the longitudinal directions of the bodies 21, 31 of the fixed-contact-side terminal 20 and the movable-contact-side terminal 30.

Further, the sealant placement part 70 may only be configured so that the tip end face 71 does not project from the bottom surface 15 of the base 11, and is not limited to a case where the tip surface 71 of the sealant placement part 70 is disposed closer to the closed space 13 than the bottom surface 15 of the base 11. For example, the tip end face 71 of the sealant placement part 70 may be configured to be flush with the bottom surface 15 of the base 11.

The dimension in the width direction of the sealant placement part 70 is not limited to twice or more the dimension in the thickness direction of the sealant placement part 70. Depending on the design of the electromagnetic relay 1 and the like, the sealant placement part 70 can be provided at a freely selected dimensional ratio.

Further, the number of the sealant placement parts 70 is not limited to one, and may be two or more.

The fixed-contact-side terminal 20 and the movable-contact-side terminal 30 are not limited to the plate shape. The fixed-contact-side terminal 20 and the movable-contact-side terminal 30 can each be set to have a freely selected shape so long as including the body fixed to the base and the leg extending from the body to the outside of the housing through the base in the thickness direction.

The seal structure of the present disclosure is not limited to the electromagnetic relay 1 including the fixed-contact-side terminal 20 and the movable-contact-side terminal 30, and any electronic device can be applied so long as including at least one terminal.

Third Embodiment

Figure 8:
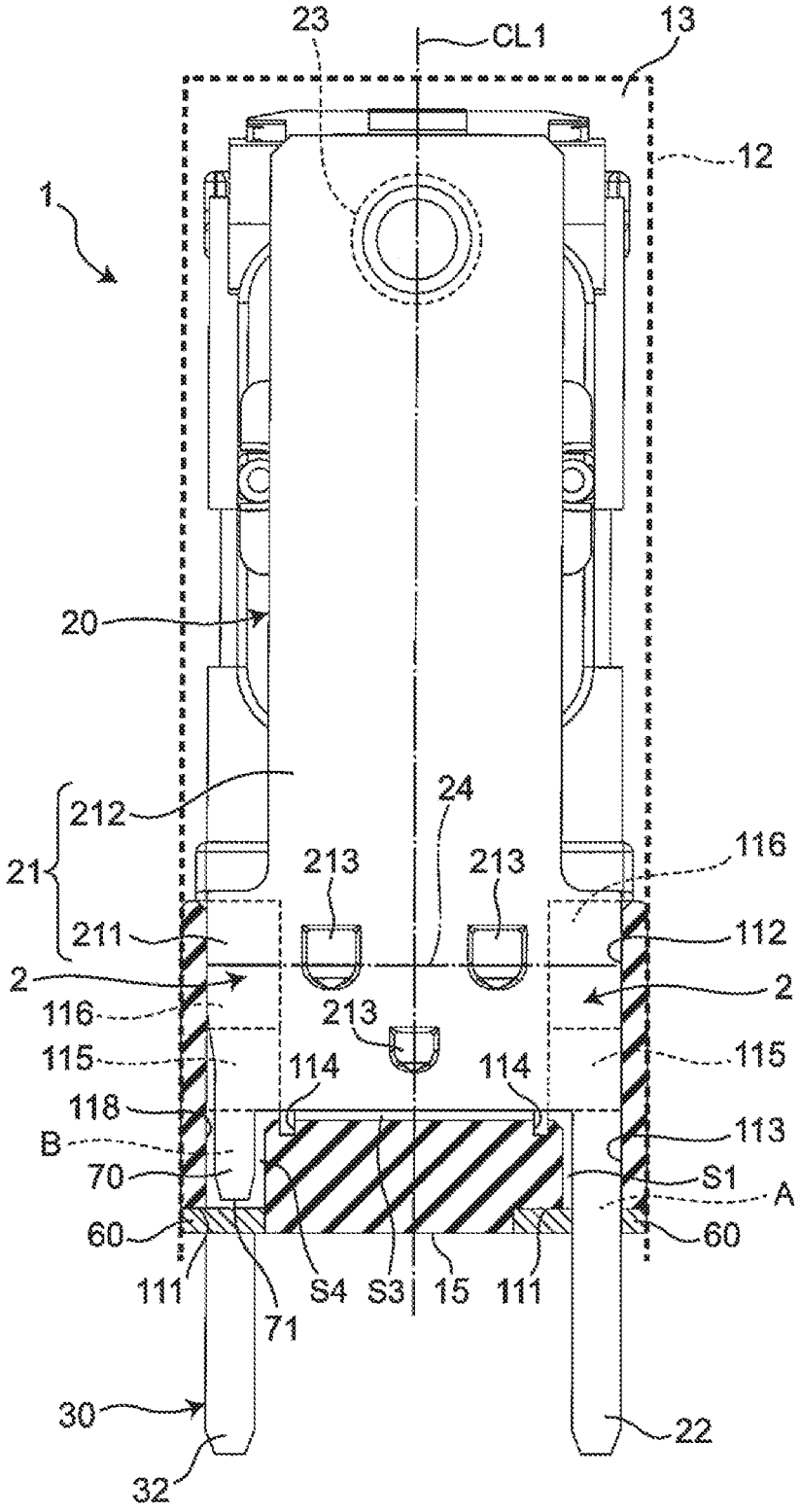
FIG. 8 is a sectional view of an electromagnetic relay according to a third embodiment of the present disclosure, taken along the line III-Ill in FIG. 2.

As illustrated in FIG. 8, an electromagnetic relay 1 according to a third embodiment of the present disclosure is different from the first embodiment in that the fixed-contact-side terminal 20 and the movable-contact-side terminal 30 each include the sealant placement part 70 of the second embodiment while the placement area forming part (i.e., the sealant restriction part) 2 made up of the recess 114 and the second portion 116 is provided in the base 11.

In the third embodiment, the same reference numerals are assigned to the same portions as those in the first embodiment and the second embodiment, the description thereof will be omitted, and points different from the first embodiment and the second embodiment will be described.

The seal structure of the electromagnetic relay 1 according to the third embodiment is realized by the fixed-contact-side terminal 20 and the movable-contact-side terminal 30 of the second embodiment and the base 11 described below.

As illustrated in FIG. 8, in a terminal groove 112 of the base 11, the placement area forming part (i.e., the sealant restriction part) 2 including the recess 114 and the second portion 116 is provided not only on the leg 22 side but also on the sealant placement part 70 side.

That is, the leg 22 of the fixed-contact-side terminal 20, the base 11, and the placement area forming part 2 form the first placement area for the sealant 60 extending from the outside of the housing 10 toward the closed space 13 through an interval between the leg 22 of the fixed-contact-side terminal 20 and the base 11. The sealant placement part 70 of the fixed-contact-side terminal 20, the base 11, and the placement area forming part 2 form the second placement area for the sealant 60 extending from the outside of the housing 10 toward the closed space 13 through an interval between the sealant placement part 70 of the fixed-contact-side terminal 20 and the base 11. Further, the leg 32 of the movable-contact-side terminal 30, the base 11, and the placement area forming part 2 form the first placement area for the sealant 60 extending from the outside of the housing 10 toward the closed space 13 through an interval between the leg 32 of the movable-contact-side terminal 30 and the base 11. The sealant placement part 70 of the movable-contact-side terminal 30, the base 11, and the placement area forming part 2 form the second placement area for the sealant 60 extending from the outside of the housing 10 toward the closed space 13 through an interval between the sealant placement part 70 of the movable-contact-side terminal 30 and the base 11. It is thus possible to control the sealant 60 disposed inside the housing 10 while restricting the range of the sealant 60 flowing into the inside of the housing 10, and more reliably improve the reliability of the electromagnetic relay 1.

Note that the placement area forming part 2 is not limited to the case of being provided on both the side of the leg 22 or 32 and the sealant placement part 70 side, and may be provided only on the leg 22 side or only on the sealant placement part 70 side.

Various embodiments of the present disclosure have been described in detail with reference to the drawings, and lastly, various aspects of the present disclosure will be described. In the following description, as an example, reference symbols are also attached.

A seal structure of a first aspect of the present disclosure is a seal structure of an electronic device, provided with: a housing 10 that includes a base 11 having a connection end face 15 and a case 12 in a box shape covering one end opening surface 14 in a direction intersecting with the connection end face 15 of the base 11, the housing 10 having on an inside a closed space 13 enclosed by the base 11 and the case 12, with a sealant 60 sealing the base 11 and the case 12; and at least one of terminals 20, 30 that includes a body 21, 31 extending in the direction intersecting with the connection end face 15 of the base 11 and disposed in the closed space 13, the body 21, 31 being fixed to the base 11, and a leg 22, 32 extending from the body 21, 31 to an outside of the housing 10 through the base 11 in the direction intersecting with the connection end face 15 of the base 11. The base 11 includes a terminal groove 112 opened to the closed space 13 and configured to accommodate the body 21, 31, a through hole 113 extending from the terminal groove 112 in the direction intersecting with the connection end face 15 of the base 11 and configured to accommodate a part of the leg 22, 32, and a placement area forming part 2 configured to form a placement area for the sealant 60 together with the body 21, 31 and the leg 22, 32 of the terminal 20, 30 and the terminal groove 112 and the through hole 113 of the base 11, the placement area extending from the outside of the housing 10 toward the closed space 13 through an interval between the through hole 113 and the leg 22, 32 and an interval between the terminal groove 112 and the body 21, 31.

According to the seal structure of the first aspect, the placement area for the sealant 60 extending from the outside of the housing 10 toward the closed space 13 through the interval between the terminal 20, 30 and the base 11 is formed of the terminal 20, 30, the base 11, and the placement area forming part 2. That is, the placement area forming part 2 positions the sealant 60 inside the housing 10. It is thereby possible to lessen the variation in the sealant 60 disposed inside the housing 10 and improve the reliability of the electronic device.

In a seal structure of a second aspect of the present disclosure, the placement area forming part 2 includes a recess 114 disposed at a bottom of the terminal groove 112 and in a vicinity of the through hole 113.

According to the seal structure of the second aspect, since the placement area forming part 2 includes the recess 114, the gap between the terminal 20, 30 and the terminal groove 112 can be reduced. It is thereby possible to reduce the size of the electronic device while improving the reliability of the electronic device.

In a seal structure of a third aspect of the present disclosure, the main body 21, 31 of the terminal 20, 30 has an elastically deformable plate shape, and includes a spring fulcrum 24 located in the terminal groove 112 while extending in a direction parallel to the plate surface and orthogonal to the connection end face 15 of the base 11, and the placement area forming part 2 is disposed closer to the base 11 than the spring fulcrum 24 in the direction intersecting with the connection end face 15 of the base 11.

According to the seal structure of the third aspect, the spring fulcrum 24 is not fixed to the base 11 by the sealant 60, so that it is possible to reduce the fluctuation of the terminal 20, 30 caused by the sealant 60.

In a seal structure of a fourth aspect of the present disclosure, a distance between the terminal 20, 30 and the base 11 in the placement area of the sealant 60 is less than 0.2 mm, and a distance between the terminal 20, 30 and the base 11 in the placement area forming part 2 is equal to or more than 0.2 mm.

According to the seal structure of the fourth aspect, the placement area forming part 2 can more reliably lessen the variation in the sealant 60 disposed inside the housing 10 to improve the reliability of the electronic device.

In a seal structure of a fifth aspect of the present disclosure, at least one of the terminals 20, 30 includes a sealant placement part 70 extending from the main body 21, 31 in the direction intersecting with the connection end face 15 of the base 11 and is disposed in parallel with the leg 22, 32 and has a length from the main body 21, 31 in the direction intersecting with the connection end face 15 of the base 11, the length being smaller a length of the leg 22, 32, and the base 11 includes a terminal groove 112 opened to the closed space 13 and in which the main body 21, 31 is accommodated, a first through hole 113 extending from the terminal groove 112 in the direction intersecting with the connection end face 15 of the base 11 and configured to accommodate a part of the leg 22, 32, and a second through hole 118 extending from the terminal groove 112 in the direction intersecting with the connection end face 15 of the base 11 and extending in parallel in the extending direction of the first through hole 113, the second through hole 118 being configured to accommodate the sealant placement part 70 so that the sealant placement part 70 does not protrude from the connection end face 15 of the base 11.

According to the seal structure of the fifth aspect, the first placement area for the sealant 60 and the second placement area for the sealant 60 are formed, the first placement area extending from the outside of the housing 10 toward the closed space 13 through the interval between the leg 22, 32 of the terminal 20, 30 and the base 11, the second placement area extending from the outside of the housing 10 toward the closed space 13 through the interval between the sealant placement part 70 of the terminal 20, 30 and the base 11. Therefore, for example, the leg 22, 32 and the sealant placement part 70 are disposed on the body 21, 31 so that the first placement area is located on one side of the center line CL1 in the width direction of the body 21, 31 of each terminal 20, 30 and that the second placement area is located on the other side of the center line CL1 in the width direction of the body 21, 31 of the respective terminal 20, 30, whereby the sealant 60 disposed inside the housing 10 can be controlled. It is thereby possible to lessen the variation in the sealant 60 disposed inside the housing 10 and improve the reliability of the electronic device.

The electronic device of the sixth aspect of the present disclosure is provided with the seal structure of the above aspect.

According to the electronic device of the sixth aspect, with the seal structure of the aspect, it is possible to lessen the variation in the range of the sealant 60 flowing into the inside of the housing 10 and obtain a highly reliable electronic device.

In an electronic device of a seventh aspect of the present disclosure, the electronic device is an electromagnetic relay 1.

According to the electronic device of the seventh aspect, with the seal structure of the aspect, it is possible to lessen the variation in the sealant 60 disposed inside the housing 10 and obtain a highly reliable electromagnetic relay 1.

A method for manufacturing an electronic device of an eighth aspect of the present disclosure is a method for manufacturing an electronic device that includes a housing 10 having a base 11 having a connection end face 15 and a case 12 in a box shape covering one end opening surface 14 in a direction intersecting with the connection end face 15 of the base 11, the housing 10 having on an inside a closed space 13 enclosed by the base 11 and the case 12, with a sealant 60 sealing a joint portion between the base 11 and the case 12, and at least one of terminals 20, 30 having a body 21, 31 disposed in the closed space 13 and fixed to the base 11 along the direction intersecting with the connection end face 15 of the base 11, and a leg 22, 32 extending from the body 21, 31 to an outside of the housing 10 through the base 11 in the direction intersecting with the connection end face 15 of the base 11. The base 11 includes a terminal groove 112 opened to the closed space 13 and configured to accommodate the body 21, 31, a through hole 113 extending from the terminal groove 112 in the direction intersecting with the connection end face 15 of the base 11 and configured to accommodate a part of the leg 22, 32, and a sealant restriction part 2 provided in an inflow path extending from the outside of the housing 10 toward the closed space 13 through an interval between the through hole 113 and the leg 22, 32 and an interval between the terminal groove 112 and the body 21, 31, and after attachment of the case 12 from the one end opening surface 14 side of the base 11 assembled with the at least one of the terminals 20, 30, an electromagnet 40, and a movable part 50, the electronic device is fixed in a state where the sealant 60 flows from the connection end face 15 side of the base 11 toward the closed space 13, to fill a joint portion between the base 11 and the case 12 with the sealant 60, and the sealant restriction part 2 restricts an inflow range of the sealant 60 passing through the inflow path A.

According to the method for manufacturing the electronic device of the eighth aspect, the range of the sealant 60 flowing into the inside of the housing 10 is restricted by the sealant restriction part 2 provided in an inflow path A extending from the outside of the housing 10 toward the closed space 13 through the interval between the through hole 113 and the leg 22, 32 and the interval between the terminal groove 112 and the body 21, 31. Hence it is possible to lessen the variation in the sealant 60 flowing into the inside of the housing 10 and obtain a highly reliable electronic device.

By appropriately combining freely selected embodiments or modified examples of the above various embodiments or modified examples, the respective effects of those combined can be exerted. While it is possible to combine embodiments, combine examples, or combine an embodiment and an example, it is also possible to combine features in different embodiments or examples.

While the present disclosure has been fully described in connection with the preferred embodiments with reference to the accompanying drawings, various modified examples or amendments will be apparent to those skilled in the art. Such modifications or amendments are to be understood as being included in the scope of the present disclosure according to the appended claims so long as not deviating therefrom.

INDUSTRIAL APPLICABILITY

The seal structure of the present disclosure can be applied to, for example, an electronic device such as an electromagnetic relay, a switch, or a sensor.

The electronic device of the present disclosure can be applied to, for example, an air conditioner or office automation equipment.

The manufacturing method of the present disclosure can be used, for example, for manufacturing electronic devices such as electromagnetic relays, switches, or sensors.

DESCRIPTION OF SYMBOLS 1 electromagnetic relay
2 placement area forming part (sealant restriction part)
10 housing
11 base
111 seal groove part
112 terminal groove
113 through hole
114 recess
115 first portion
116 second portion
117 wall
118 through hole
12 case
13 closed space
14 one end opening surface
15 connection end face
20 fixed-contact-side terminal 20 (an example of a terminal)
21 body
211 base part
212 contact placement part
213 press-fit projection
22 leg
23 fixed contact
24 spring fulcrum
30 movable-contact-side terminal 30 (an example of the terminal)
31 body
312 contact placement part
32 leg
33 movable contact
40 electromagnet
41 coil
42 yoke
43 magnetic pole part
50 movable part
51 movable iron piece
511 corner
52 movable member
60 sealant
70 sealant placement part
71 tip surface
CL1, CL2 center line
L1 to L5 distance
S1 to S4 gap
A, B Inflow path

The invention claimed is:

1. A seal structure of an electronic device, comprising:

a housing that includes a base having a connection end face and a case in a box shape covering one end opening surface in a direction intersecting with the connection end face of the base, the housing having on an inside a closed space enclosed by the base and the case, with a sealant sealing the base and the case; and at least one of terminals that includes a body extending in the direction intersecting with the connection end face of the base and disposed in the closed space, the body being fixed to the base, and a leg extending from the body to an outside of the housing through the base in the direction intersecting with the connection end face of the base, wherein the base includes a terminal groove opened to the closed space and configured to accommodate the body, a through hole extending from the terminal groove in the direction intersecting with the connection end face of the base and configured to accommodate a part of the leg, a placement area forming part configured to form a placement area for the sealant together with the body and the leg of the terminal and the terminal groove and the through hole of the base, the placement area extending from the outside of the housing toward the closed space through an interval between the through hole and the leg and an interval between the terminal groove and the body, and the placement area forming part includes a recess disposed at a bottom of the terminal groove and in a vicinity of the through hole.

2. The seal structure according to claim 1, wherein the body of the terminal has an elastically deformable plate shape, and includes a spring fulcrum located in the terminal groove and extending in a direction parallel to the plate surface and orthogonal to the connection end face of the base, and the placement area forming part is disposed closer to the base than the spring fulcrum in the direction intersecting with the connection end face of the base.

3. The seal structure according to claim 1, wherein a distance between the terminal and the base in the placement area for the sealant is less than 0.2 mm, and a distance between the terminal and the base in the placement area forming part is equal to or more than 0.2 mm.

4. The seal structure according to claim 1, wherein at least one of the terminals includes a sealant placement part extending from the body in the direction intersecting with the connection end face of the base and disposed in parallel with the leg, the sealant placement part having a length, from the body in the direction intersecting with the connection end face of the base, smaller than a length of the leg, and the base includes a terminal groove that opens to the closed space and in which the body is accommodated, a first through hole extending from the terminal groove in the direction intersecting with the connection end face of the base and configured to accommodate a part of the leg, and a second through hole extending from the terminal groove in the direction intersecting with the connection end face of the base and extending in parallel with the extending direction of the first through hole, the second through hole being configured to accommodate the sealant placement part so that the sealant placement part does not project from the connection end face of the base.

5. An electronic device comprising the seal structure according to claim 1.

6. The electronic device according to claim 5, wherein the electronic device is an electromagnetic relay.

7. A method for manufacturing an electronic device that includes a housing having a base having a connection end face and a case in a box shape covering one end opening surface in a direction intersecting with the connection end face of the base, the housing having on an inside a closed space enclosed by the base and the case, with a sealant sealing a joint portion of the base and the case, and at least one of terminals having a body disposed in the closed space and fixed to the base along the direction intersecting with the connection end face of the base, and a leg extending from the body to an outside of the housing through the base in the direction intersecting with the connection end face of the base, wherein the base includes a terminal groove opened to the closed space and configured to accommodate the body, a through hole extending from the terminal groove in the direction intersecting with the connection end face of the base and configured to accommodate a part of the leg, and a sealant restriction part provided in an inflow path extending from the outside of the housing toward the closed space through an interval between the through hole and the leg and an interval between the terminal groove and the body, the sealant restriction part includes a recess disposed at a bottom of the terminal groove and in a vicinity of the through hole, and after attachment of the case from the one end opening surface side of the base assembled with the at least one of the terminals, an electromagnet, and a movable part, the electronic device is fixed in a state where the sealant flows from the connection end face side of the base toward the closed space, to fill a joint portion between the base and the case with the sealant, and the sealant restriction part restricts an inflow range of the sealant passing through the inflow path.

* * * * *